US006381984B1

(12) United States Patent
Russo et al.

(10) Patent No.: US 6,381,984 B1
(45) Date of Patent: May 7, 2002

(54) SCENTED JEWELRY

(76) Inventors: Gay Ellen Russo; Ronald Paul Russo, both of 97 Church St., Chagrin Falls, OH (US) 44022

( * ) Notice: Subject to any disclaimer, the term of this patent is extended or adjusted under 35 U.S.C. 154(b) by 0 days.

(21) Appl. No.: 09/543,029

(22) Filed: Apr. 5, 2000

Related U.S. Application Data

(60) Provisional application No. 60/128,251, filed on Apr. 8, 1999.

(51) Int. Cl.[7] ..... A44C 13/00

(52) U.S. Cl. ..... 63/1.15; 63/1.14; 63/23; 63/DIG. 2; 29/896.4; 29/896.41

(58) Field of Search ..... 63/1.11, 1.14, 63/1.15, 23, 26, 31, DIG. 2, FOR 1.1; 29/10, 896.4, 896.41

(56) References Cited

U.S. PATENT DOCUMENTS

| | | | | |
|---|---|---|---|---|
| 168,972 A | * | 10/1875 | Dayton | 239/55 |
| 195,324 A | | 9/1877 | Atkinson | |
| 292,963 A | | 2/1884 | Thie | |
| 367,976 A | | 8/1887 | Hartman | |
| 1,267,067 A | | 5/1918 | Flagg | |
| 2,058,274 A | | 10/1936 | Vivaudou et al. | |
| 2,109,092 A | | 2/1938 | Roll | |
| 2,550,828 A | | 5/1951 | Lawson, Jr. et al. | |
| 2,564,860 A | | 8/1951 | Ryberg | |
| 2,740,662 A | | 4/1956 | Scott | |
| 2,749,920 A | * | 6/1956 | Kriesman et al. | 132/223 |
| 4,056,951 A | | 11/1977 | Black | |
| 4,159,631 A | | 7/1979 | Lee | |
| 4,452,052 A | | 6/1984 | Hodge | |
| 4,744,514 A | | 5/1988 | Gadoua | |
| 5,031,419 A | | 7/1991 | Gelman | |

* cited by examiner

*Primary Examiner*—B. Dayoan
*Assistant Examiner*—Andrea Chop
(74) *Attorney, Agent, or Firm*—Robert R. Hussey Co. LPA

(57) ABSTRACT

A rechargeable article of jewelry dispenses perfumed vapors and has a chamber formed from housing members. The housing members are made of a material which contains the perfumed vapors in the chamber and allows for releasing them into the atmosphere. A nugget of unglazed ceramic material is provided in the chamber and is of a size less than the chamber so that it is free to move inside the chamber and allow air to pass around the nugget. The chamber has apertures therein through which an aromatic liquid, such as perfume, can be deposited on and absorbed by the nugget. The apertures also allow air to circulate around the nugget and generate perfumed vapors which may exit the chamber through the apertures. The nugget is larger than any of the apertures so the nugget is retained in the chamber. A method of making scented jewelry is also provided.

15 Claims, 1 Drawing Sheet

SCENTED JEWELRY

CROSS-REFERENCE TO RELATED APPLICATIONS

This patent application claims the benefit of U.S. Provisional Patent Application Serial No. 60/128,251 filed on Apr. 8, 1999.

BACKGROUND OF THE INVENTION

This invention relates in general to jewelry, and more particularly to scented jewelry which is adapted to dispense perfumed vapors from a sorbent material permanently contained in a chamber.

It is desirable to provide a scented jewelry article which allows the housing components of the jewelry forming the chamber to be permanently affixed together, such as by soldering, without damaging the sorbent material holding the perfume during the affixing or soldering process. In addition, it is desirable to provide a joint design between the housing components which allows for ready attachment of the housing components.

During the normal use of jewelry, it may be impacted or otherwise mishandled causing breakage or otherwise rendering the jewelry unusable. It is desirable to provide scented jewelry which protects the sorbent material from damage after the housing components are assembled and when the jewelry is in use, creating a long product life.

Known housing components have been snapped together or screwed together (U.S. Pat. Nos. 1,267,067; 2,109,092; 2,550,828; 2,564,860; 2,740,662; 4,056,951; 4,159,631) and other references disclose hinging the housing components together (U.S. Pat. No. 2,740,662). When the housing components are snapped together, screwed together, or hinged, when impacted or otherwise mishandled, they may become disassembled and components lost or damaged. In fact, in some cases, injury to the wearer of the jewelry may occur when the housing components disassemble. Other housing components have been wood, as disclosed in U.S. Pat. No. 2,058,274, which is does not have very high porosity to allow the perfumed vapors into the atmosphere. Other known chambers include cartridges, charged glass (U.S. Pat. Nos. 2,058,274 and 4,452,052) and hollow reservoirs for the aromatic liquid (U.S. Pat. No. 4,056,951).

Is also desirable to provide scented jewelry using a sorbent material that quickly absorbs aromatic liquids, such as perfume, and then evaporates the aromatic liquid over a period of hours. Such a desirable feature allows for extended use of the jewelry and dispensing perfumed vapors.

In order to effectively create the perfumed vapors, it is also desirable to provide for circulation of air around the sorbent material and into the atmosphere in the proximity of the jewelry. This allows more effective generation of the perfumed vapors by the scented jewelry.

Known jewelry for dispensing perfumed vapors usually have cloth-like sorbent materials such as cotton (U.S. Pat. Nos. 292,963; 1,267,067 and 2,740,662), fiberous sheets (U.S. Pat. No. 2,109,092), gauzes and wicks (U.S. Pat. No. 4,159,631), and disposable pads (U.S. Pat. No. 2,5500,828). Such sorbent materials are damaged by heat. Other known jewelry, as described in U.S. Pat. No. 195,324, is provided the porous earths, clays, or cement with water which are poured into shape and bake to be used as a perfumed charm. Unglazed ceramic beads and such have been used with an aromatic liquid are also known but have a more nonporous outer surface resulting from the firing of the ceramic beads.

More unusual sorbent materials have also been provided as for example a sponge, (U.S. Pat. No. 367,976) and a blend of diatomaceous earth and plaster of Paris in a non-jewelry sachet (U.S. Pat. No. 2,564,860).

It is also desirable to provide a article of jewelry for dispensing perfumed vapors that is rechargeable, in which an aromatic liquid can be deposited in the jewelry so that perfumed vapors may continue to be dispensed by the jewelry. Such a rechargeable feature also allows the scented of the perfumed vapors to be changed.

It is desirable to provide a design for aromatic jewelry which is unique and can be adapted to a wide variety of exterior designs and geometric configurations depending on the artisan designing the jewelry while still achieving the above described desirable features.

SUMMARY OF THE PRESENT INVENTION

The present invention provides a rechargeable article of jewelry which dispenses perfumed vapors and has a chamber formed from housing members which are made of a material which contain the perfumed vapors in the chamber. The housing members are permanently affixed to each other when the jewelry is formed. The present invention provides for the housing components of the jewelry forming the chamber to be permanently affixed together, such as by soldering, without damaging the sorbent material holding the perfume during the soldering process. A joint design between the housing components is also provided which allows for ready attachment of the housing components.

A nugget of unglazed ceramic material is provided in the chamber and is of a size less than the chamber so that it is free to move inside the chamber and allow air to pass around the nugget. This particular material, unglazed ceramic, allows the housing components to be permanently affixed together without damaging the sorbent material during the affixing process, such as soldering.

The chamber has apertures therein through which an aromatic liquid, such as perfume, can be deposited on and absorbed by the nugget. The apertures also allow air to circulate around the nugget and generate perfumed vapors which may exit the chamber through the apertures. The nugget is larger than any of the apertures so the nugget is retained in the chamber. Since the nugget can freely move in the chamber, air can circulate around the nugget to effectively create perfumed vapors which flows through the apertures and into the atmosphere in the proximity of the jewelry. This allows more effective generation of the perfumed vapors by the jewelry of the present invention.

The unglazed ceramic material from which the nugget is formed does not have the outer surface formed when the ceramic material is fired. This outer surface is removed before or during formation of the nugget. This outer surface is removed before or during formation of the nugget. It has been found that terra cotta material provides the favorable characteristics of a sorbent material that quickly absorbs aromatic liquids, such as perfume, and then allow for evaporation of the aromatic liquid over a period of hours. Terra cotta allows for extended use of the jewelry and dispensing perfumed vapors.

The present invention provides jewelry for dispensing perfumed vapors that is rechargeable. Aromatic liquid can be deposited in the jewelry through the apertures and onto the nugget so that the jewelry is recharged and perfumed vapors may continue to be dispensed by the jewelry. It should be understood that this rechargeable feature also allows different aromatic liquids to be deposited on the nugget so that the odor of the perfumed vapors can be changed.

The present invention also provides a jewelry design which is unique and can be adapted to a wide variety of exterior designs and geometric configurations depending on the artisan designing the jewelry while still achieving the above described desirable features.

A method of making scented jewelry is also provided. The method includes the steps of forming a plurality of housing members having complementary peripheral edges with the housing members having apertures therein. The nugget of unglazed ceramic material is then positioned adjacent one of the housing members and then the complementary peripheral edges of the housing members are positioned adjacent to and into contact with each other to form the chamber containing the nugget. The complementary peripheral edges of the housing members are affixed to each other to form a chamber containing the nugget. Other steps are also provided to achieve the desirable features of the product described above as will be more fully described.

Other desirable features and advantages of the present invention will become apparent from a study of the following description in the accompanying drawings which are illustrative of the invention.

DETAILED DESCRIPTION OF THE INVENTION

Figure 1:
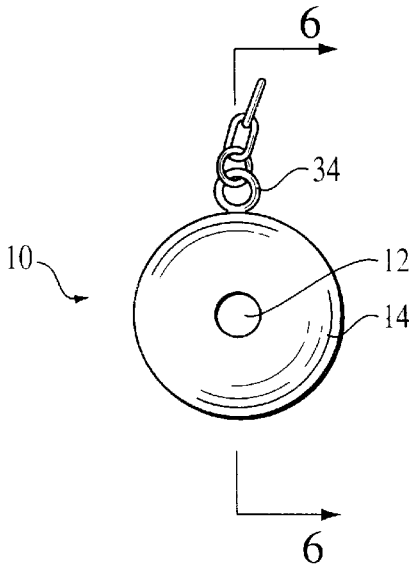
FIG. 1 is a side view of the aromatic jewelry housing of the present invention.
Figure 2:
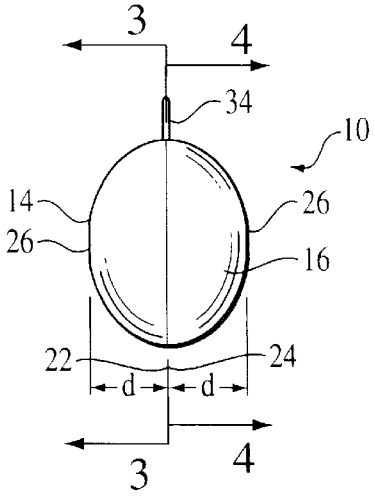
FIG. 2 is an end view of the aromatic jewelry housing shown in FIG. 1.
Figure 3:
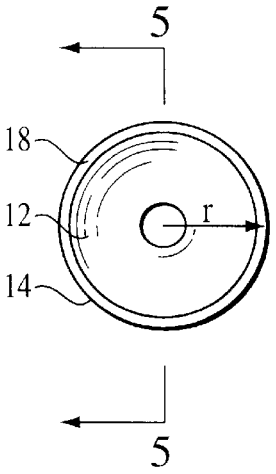
FIG. 3 is a sectional view of the aromatic jewelry housing shown in FIG. 2 and taken along line 3—3 thereof.
Figure 4:
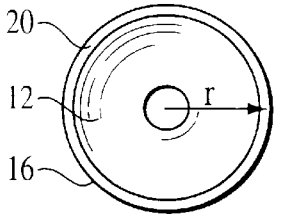
FIG. 4 is a sectional view of the aromatic jewelry housing shown in FIG. 2 and taken along line 4—4 thereof.
Figure 5:
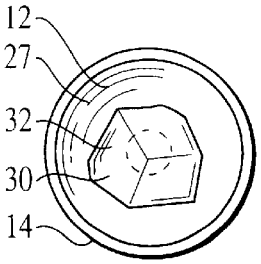
FIG. 5 is a sectional view of the aromatic jewelry housing shown in FIG. 3 with a porous claim member positioned therein.
Figure 6:
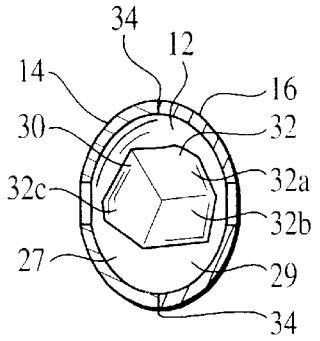
FIG. 6 is a sectional view of the aromatic jewelry housing shown in FIG. 1 and taken along line 6—6 thereof.

The present invention provides a rechargeable article of jewelry 10 which dispenses perfumed vapors and has a chamber 12 formed from housing members 14, 16 which are made of a material which contains the perfumed vapors in the chamber as seen in FIGS. 1–6. Preferably, such material is one that is commonly used in making jewelry, for example, sterling silver or gold. It has been found that the thickness of the material is preferably about 22-4 gauge metal.

As shown in the figures, the housing members 14, 16 are identically formed in a generally semi elliptical shape. The housing members 14, 16 have outer peripheral edges or surfaces 18, 20 respectively and are generally circular with a radius "r". The respective peripheral surfaces 16, 18 are formed to contact each other when assembled and form the chamber 12. A plane 22 passes through the peripheral surface 18 and a plane 24 passes through the peripheral surface 20. The tops 26, 28 of the housing members 14, 16 respectively are spaced a distance "d" perpendicular from the planes 22, 24. The distance "d" is less than the radius "r". Such a joint design between the housing components 14, 16 provides for ready attachment of the housing components. This particular geometric configuration also allows for better mating of the peripheral surfaces 18, 20 and facilitates more ready manufacture of the jewelry 10. The housing members 14, 16 are formed with a cavity 27, 29 respectively which forms part of the chamber 12 when the housing members are assembled.

It should be understood that the housing members may be more than two in number and configured as the artisan designing the jewelry requires. Of course, it should be understood that if more than two housing members are used, the peripheral surfaces of the housing members are formed to contact complementary peripheral surfaces of another housing member to form a chamber.

A nugget 30 of unglazed ceramic material is provided in the chamber 12 and is of a size less than the chamber so that it is free to move inside the chamber and allow air to pass around the nugget. The particular material forming the nugget 30, unglazed ceramic, allows the housing components to be permanently affixed together without damaging the sorbent material during the affixing process, such as soldering, as will be hereinafter more fully described.

When unglazed ceramic material is fired, its outer peripheral surface is slightly nonporous than the inner material. The unglazed ceramic material from which the nugget 30 is formed has the outer surface formed when the ceramic material is fired removed. Such outer peripheral surface of the unglazed ceramic material is removed by any known method, such as chiseling or cutting and it may be removed either before or during formation of the nugget 30. By removing this outer surface, the nugget 30 as a higher degree of and more uniform porosity and can quickly absorbs aromatic liquids, such as perfume, and then allow for evaporation of the aromatic liquid over a period of hours.

The outer surface 32 of the nugget 30 as irregular, and rough, such as created by chiseling, which provides a nugget with a shape that allows improve dispensing of aromatic liquid. The outer surface includes a number of sides, 32*a*, 32*b*, 32*c* which creates a "tumbling" action on the nugget 30 for allowing the flow of air around the nugget 30 as the jewelry 10 is moved.

It has been found that one unglazed ceramic material, terra cotta, which is fired natural ferruginous clay, provides the favorable characteristics of a sorbent material that quickly absorbs aromatic liquids, such as perfume, and then allows for evaporation of the aromatic liquid over a period of hours. Terra cotta allows for extended use of the jewelry and dispensing perfumed vapors. Terra cotta material is also used to form the nugget 30 since it can withstand the heat generated when the housing members 14, 16 are joined, such as by soldering, and is not damaged during this process.

The present invention provides for the housing components 14, 16 of the jewelry forming the chamber 12 to be permanently affixed together, such as by soldering, without damaging the sorbent material during the soldering process. To assemble the nugget 30 and housing components 14, 16, the nugget 30 is placed in one of the cavities 27, 29 in one of the housing members 14, 16. The other housing member is then positioned so that the peripheral surfaces 18, 20 are in contact with each other. The housing members 14, 16 are then permanently affixed together by soldering them together. Solder 34 is positioned adjacent the peripheral surfaces 18, 20 and heat is applied to the solder, which flows around the peripheral surfaces to join the housing members 14, 16 together with the nugget 30 inside the chamber 12. To provide for attachment of the jewelry article 10 to an earring, ring, pendant, bracelet or the like, a jump ring 34 is attached, such as by solder, to the article of jewelry 10.

The chamber 12 has apertures 36 in each of the housing members 14, 16 through which an aromatic liquid, such as perfume, can be deposited on and absorbed by the nugget 30 inside the chamber. The apertures may be of any configuration as designed by the artisan and may be used to add to the aesthetic appeal of the jewelry. The apertures 36 are preferably formed in the housing members 14, 16 before assembly but it should be understood that they may be formed after assembly of the housing members. The nugget 30 is larger than any of the apertures 36 so the nugget is retained in the chamber 12. The apertures 36 may be of any shape or configuration desired by the artisan. The apertures 36 also allow air to circulate around the nugget 30 and generate perfumed vapors which may exit the chamber 12 through the apertures.

Since the nugget 30 can freely move in the chamber 12, air can circulate into the apertures 36, and around the nugget to effectively create perfumed vapors which then flow back through the apertures and into the atmosphere in the proximity of the jewelry 10. As the wearer of the jewelry 10 moves, the nugget 30 is moved in the chamber 12. This allows more effective generation of the perfumed vapors by the jewelry 10 of the present invention.

The present invention provides jewelry 10 for dispensing perfumed vapors that is rechargeable. Aromatic liquid can be deposited in the jewelry through the apertures 36 and onto the nugget so that perfumed vapors may continue to be dispensed by the jewelry. The aromatic liquid may be any perfume, including essential oils, that provides the desired scent. It should be understood that this rechargeable feature also allows different aromatic liquids to be deposited on the nugget so that the perfumed vapors can be changed.

The present invention also provides a jewelry design which is unique and can be adapted to a wide variety of exterior designs and geometric configurations depending on the artisan designing the jewelry while still achieving the above described desirable features.

A method of making scented jewelry 10 is also provided. The method includes the steps of forming a plurality of housing members 14, 16 having complementary peripheral edges 16, 18 with the housing members having apertures 36 therein. The nugget 30 of unglazed ceramic material is then positioned adjacent one of the housing members 14, 16 in its respective cavity 27, 29 and then the complementary peripheral edges 16, 18 of the housing members 14, 16 are positioned adjacent to and into contact with each other to form the chamber containing the nugget. The complementary peripheral edges 16, 18 of the housing members 14, 16 are affixed to each other to form a chamber 12 containing the nugget 30. Other steps are also provided to achieve the desirable features of the product described above.

The invention has been described with reference to the preferred embodiment. Obviously, modifications and alterations will occur to others upon reading and understanding of this specification. It is our intention to include all modifications and alterations in so far as they come within the scope of the appended claims or equivalents thereof.

Having described my invention, we claim:

1. A rechargeable article of jewelry for dispensing perfumed vapors, comprising:

a chamber formed from a plurality of housing members permanently joined together with solder, a nugget of unglazed ceramic material of a size less than said chamber, said nugget positioned inside said chamber and free to move inside said chamber and allow air to pass around said nugget, said chamber having at least one aperture therein through which perfume can be deposited on and absorbed by said nugget and through which air may circulate around said nugget and generate perfumed vapors, which perfumed vapors may exit said chamber through said aperture, and said nugget being larger than any one of said apertures so said nugget is retained in said chamber.

2. A rechargeable article of jewelry for dispensing perfumed vapors as described in claim 1 wherein said nugget being formed of unglazed ceramic material without an outer surface formed when said ceramic material is fired.

3. A rechargeable article of jewelry for dispensing perfumed vapors as described in claim 1 wherein said nugget is formed from fired natural ferruginous clay.

4. A rechargeable article of jewelry for dispensing perfumed vapors as described in claim 1 wherein said housing members are formed from metal, said housing members having peripheral edges formed to contact each other and form said chamber, and including solder for joining said housing members along said peripheral edges of said housing members.

5. A rechargeable article of jewelry for dispensing perfumed vapors as described in claim 4 wherein said housing members include a pair of generally semi elliptical members, each of said semi elliptical members having a top and a generally circular peripheral edge formed about a radius, at least one of said semi elliptical members having a perpendicular distance between a plane passing through said circular peripheral edge and said top of said housing member which is less than said radius of said circular peripheral edge.

6. A rechargeable article of jewelry for dispensing perfumed vapors as described in claim 5 wherein said one aperture in said housing is at said top of said housing member.

7. A rechargeable article of jewelry for dispensing perfumed vapors as described in claim 1 including a jump ring attached to at least one of said housing members.

8. A rechargeable article of jewelry for dispensing perfumed vapors as described in claim 1 wherein said nugget has a plurality of roughened sides.

9. A method for making a rechargeable article of jewelry for dispensing perfumed vapors including the steps of:

forming a plurality of housing members having complementary peripheral edges and at least one of the housing members having an aperture therein, positioning a nugget of unglazed ceramic material adjacent one of said housing members, positioning the complementary peripheral edges of the housing members adjacent to and in contact with each other to form a chamber containing the nugget therein, the nugget is of a size less than the chamber and is free to move therein, soldering the complementary peripheral edges of the housing members to each other to form a chamber containing the nugget.

10. A method for making a rechargeable article of jewelry for dispensing perfumed vapors as described in claim 9 which includes the step of forming the nugget from unglazed ceramic material before the step of positioning a nugget of unglazed ceramic material adjacent one of the housing members.

11. A method for making a rechargeable article of jewelry for dispensing perfumed vapors as described in claim 10 in which the step of forming the nugget from unglazed ceramic material includes the step of removing the outer surface formed when the ceramic material is fired.

12. A method for making a rechargeable article of jewelry for dispensing perfumed vapors as described in claim 9 which includes the step of removing the outer surface formed when the ceramic material is fired before the step of positioning a nugget of unglazed ceramic material adjacent one of the housing members.

13. A method for making a rechargeable article of jewelry for dispensing perfumed vapors as described in claim 9 in which the step of forming a plurality of housing members includes the step of forming a pair of generally semi elliptical members, said semi elliptical members having a top and a generally circular peripheral edge lying in a plane and formed about a radius and wherein at least one of said semi elliptical member having a perpendicular distance between said plane passing through said circular peripheral edge and said top of said one semi elliptical member is less than said radius of said circular peripheral edge.

14. A method for making a rechargeable article of jewelry for dispensing perfumed vapors as described in claim 13 in which the step of forming a plurality of housing members includes the step of forming at least one aperture in one of the housing members at said top of the housing member, the nugget being larger than any of said one apertures so said nugget is retained in said chamber.

15. A method for making a rechargeable article of jewelry for dispensing perfumed vapors as described in claim 9 which includes the step of attaching a jump ring to at least one of the housing members.

* * * * *